US007942101B2

(12) United States Patent
Conley

(10) Patent No.: US 7,942,101 B2
(45) Date of Patent: May 17, 2011

(54) LEG ADJUSTER FOR A WORK SUPPORT

(76) Inventor: Roy P. Conley, Elyria, OH (US)

( * ) Notice: Subject to any disclaimer, the term of this patent is extended or adjusted under 35 U.S.C. 154(b) by 375 days.

(21) Appl. No.: 12/168,682

(22) Filed: Jul. 7, 2008

(65) Prior Publication Data

US 2009/0031927 A1 Feb. 5, 2009

Related U.S. Application Data

(60) Provisional application No. 60/948,459, filed on Jul. 7, 2007.

(51) Int. Cl.
*A47B 3/00* (2006.01)

(52) U.S. Cl. ..... 108/129; 108/131; 108/10; 248/188.6

(58) Field of Classification Search ..... 108/131, 108/129, 125, 126, 127, 128, 130, 132, 10; 248/286.1, 188.6
See application file for complete search history.

(56) References Cited

U.S. PATENT DOCUMENTS

| | | | | |
|---|---|---|---|---|
| 167,659 | A | 9/1875 | Githens | |
| 355,347 | A | 1/1887 | Sergeant | |
| 365,733 | A | 6/1887 | Cullingworth | |
| 873,885 | A | 12/1907 | Goldin | |
| 1,706,215 | A * | 3/1929 | Davidson | 403/385 |
| 2,023,155 | A | 12/1935 | Turner | |
| 2,556,261 | A | 6/1951 | Emma | |
| 2,844,345 | A | 7/1958 | Sherman | |
| 2,956,849 | A | 10/1960 | Dow | |
| 3,123,935 | A | 3/1964 | Williams | |
| 3,408,032 | A * | 10/1968 | Francis | 297/188.18 |
| 3,554,585 | A | 1/1971 | Sorenson | |
| 4,050,661 | A | 9/1977 | Wooldridge | |
| 4,440,096 | A | 4/1984 | Rice et al. | |
| 4,547,092 | A | 10/1985 | Vetter et al. | |
| 4,655,426 | A | 4/1987 | von Dulong et al. | |
| 4,747,569 | A | 5/1988 | Hoshino | |
| 4,958,737 | A | 9/1990 | Auerbach | |

(Continued)

FOREIGN PATENT DOCUMENTS

DE 3939216 A1 6/1990

(Continued)

OTHER PUBLICATIONS

Robert P. Conley, Keyboard Support Apparatus, U.S. Appl. No. 10/647,710, filed Aug. 25, 2003 Application abandoned, never published.

*Primary Examiner* — José V Chen
(74) *Attorney, Agent, or Firm* — D.A. Stauffer Patent Services

(57) ABSTRACT

Apparatus for adjusting the longitudinal and angular position of a work surface support leg. The leg passes through a channel in a cap held via a spring and pin to a base affixed to the work surface. The leg's angular position is adjusted by rotating the cap, which moves a tooth through a series of mating depressions. The longitudinal position is adjusted by moving the leg which has a series of notches that mate with a locking tooth in the cap. A knob interfaces with the cap via a rotary cam having high and low steps and a matching cam rider. The low step allows separation between the cap and base and the high step locks the cap to the base, thereby locking in the adjustment setting for the leg.

2 Claims, 4 Drawing Sheets

U.S. PATENT DOCUMENTS 5,123,768 A * 6/1992 Franklin ..... 403/96
5,243,921 A 9/1993 Kruse et al.
5,467,721 A 11/1995 Gosch
5,478,034 A 12/1995 Cunningham et al.
5,513,825 A 5/1996 Gutgsell
5,595,428 A 1/1997 Huang
5,704,698 A 1/1998 Lin
5,711,572 A 1/1998 Khan
5,758,586 A 6/1998 Kieser et al.
5,779,213 A 7/1998 Buchanan
5,810,301 A 9/1998 McGrath et al.
D410,910 S 6/1999 Martell
6,036,011 A 3/2000 DeCurtis et al.
6,036,288 A 3/2000 Shih
6,092,771 A 7/2000 Fich
6,135,399 A 10/2000 Savoie et al.
6,497,391 B1 12/2002 Timm
6,505,797 B1 1/2003 Dempsey
6,598,544 B2 * 7/2003 Laws et al. ..... 108/131
6,719,257 B1 4/2004 Greene
7,560,633 B1 * 7/2009 Wang ..... 84/421
7,686,275 B2 * 3/2010 Scarcello ..... 248/286.1
2002/0149562 A1 10/2002 Maynard, Jr.
2003/0173475 A1 9/2003 Hsieh
2004/0144905 A1 * 7/2004 Ropertz et al. ..... 248/286.1

FOREIGN PATENT DOCUMENTS

JP 11039081 A 2/1999

* cited by examiner

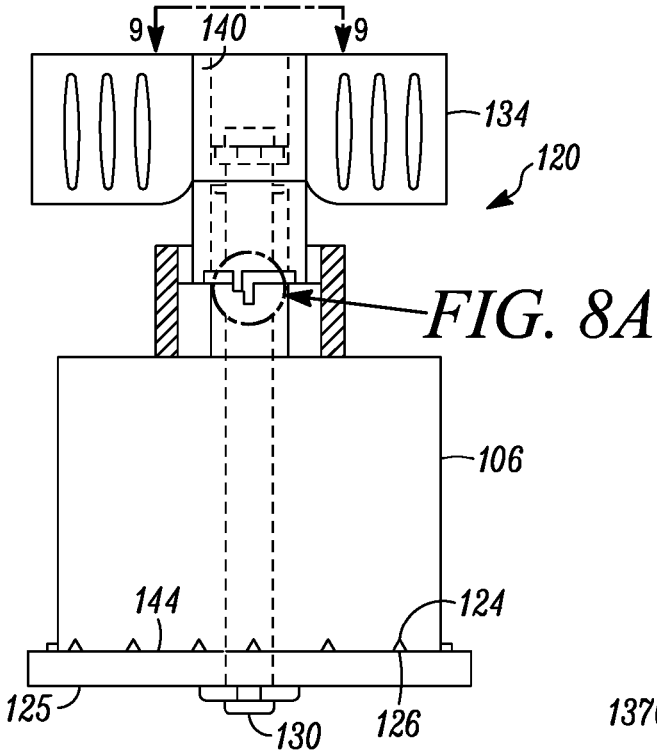
FIG. 8A
FIG. 8
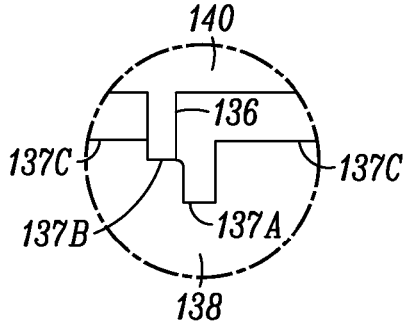
FIG. 8A
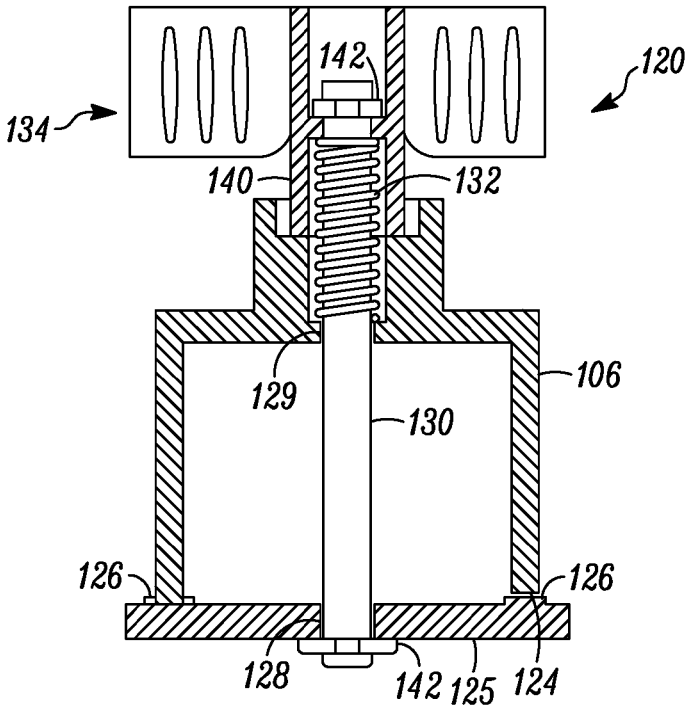
FIG. 9

LEG ADJUSTER FOR A WORK SUPPORT

CROSS-REFERENCE TO RELATED APPLICATIONS

This application claims the benefit of U.S. Provisional Patent Application No. 60/948,459, filed Jul. 7, 2007 by Roy P. Conley.

TECHNICAL FIELD OF THE INVENTION

The present invention relates to work supports, and more particularly to adjustable legs for portable desk tops.

BACKGROUND OF THE INVENTION

Assistive Technology (AT) is a generic term that includes assistive, adaptive, and rehabilitative devices and the process used in selecting, locating, and using them. AT promotes greater independence for people with disabilities by enabling them to perform tasks that they were formerly unable to accomplish, or had great difficulty accomplishing, by providing enhancements to or changed methods of interacting with the technology needed to accomplish such tasks. According to disability advocates, technology, all too often, is created without regard to people with disabilities, and unnecessary barriers make new technology inaccessible to hundreds of millions. Universal accessibility (universal design) means excellent usability, particularly for people with disabilities. But, argue advocates of assistive technology, universally accessible technology also yields great rewards to any user; widely accessible design is good design, they say. The classic example of an assistive technology that has improved everyone's life is the curb cuts in the sidewalk at street crossings. While these curb cuts surely enable pedestrians with mobility impairments to cross the street, they have also aided parents with carriages and strollers, shoppers with carts, and travelers and workers with pull-type bags, not to mention bicyclists, skateboarders and inline skaters.

Previous art has disclosed portable desks such as lap desks and bed tables. These provide a generally planar rigid platform as a small portable work surface (i.e., desktop) that may be supported on legs, but in many cases the legs aren't adjustable in terms of height and/or angle relative to the plane of the desktop. As assistive technology, these desks provide not just convenience for the able bodied, but provide needed alternative placement of, for example, keyboards and mice (e.g., at a wheelchair), and/or provide support for arm(s) or upper body of those who are handicapped by back and/or muscular problems, such as Parkinson's disease, multiple sclerosis and the like. Thus, for the latter, the desk becomes not only a work surface (desktop for items being worked on), but also a "work support" in that the desk supports both the work and, at least partially, the worker.

Particularly for the handicapped, therefore, there is a great need for adjustable desk (work support) legs to accommodate, for example, a user's height and leg/lap size; or for example, different situational placements. For example, the desk may need different leg placement when used in a wheelchair versus in a bed. For example, a painter with back and arm support problems may want to adjust the leg height according to the portion of a canvas that he/she is painting. Thus the desk/work support may need to be adjusted high or low, level or tilted in any direction, with legs angled back or forward to reach an appropriate base (e.g., angled back to the seat of a wheelchair), and so on. Furthermore, for those with disabilities, adjustments of the legs should be as simple and quick as possible, as well as not requiring much strength, mobility, or dexterity of arm, hand, or fingers.

Work support placement changes generally require adjustment of both leg length and angle, often simultaneously for a given leg, and usually front and back legs require different adjustments (assuming a typical arrangement of four legs near the corners of a rectangular desktop). In such cases, it is also common to need the same adjustment made for at least a pair of the legs (e.g., both back legs). Thus it is desirable to be able to recognize an adjustment setting made on one leg such that the setting can be readily duplicated on another leg.

Thus, it is an object of the present invention to provide adjustable work support legs that accommodate the limitations imposed upon people with disabilities, particularly relating to the back and/or muscles, while simultaneously providing superior convenience for the able bodied.

More particularly, it is an object to provide individual leg adjusters that can be operated by one hand with minimal requirements of strength, dexterity, and movement range (mobility). It is a further object to enable simultaneous adjustment of both length and angle for a leg, and for the adjustment to be restricted to discrete angle and length (longitudinal) adjustment steps that provide easily controlled, recognizable and duplicatable leg positioning.

BRIEF SUMMARY OF THE INVENTION

According to the invention, a leg adjuster, comprising a cap, base, and knob, is held together by an axial pin with a compression spring biasing the cap against the base. The base is attached to a platform (work surface, work support, desk top), and a leg passes through a channel in the cap, the channel being open to the base. The legs are supplied in several standard lengths with optional padded extenders. The leg adjuster is unlocked by a discrete turn of the knob which rides on a rotary cam surface. The rotary cam has a high step limiting rotation to a discrete turn, a medium step that prevents separation of the mechanism, thereby locking it at a particular adjustment, and a low step which unlocks the mechanism to allow separation of the cap from the base, thereby enabling simultaneous but one-handed adjustment of the longitudinal and angular position of the leg. Notches in the leg mesh with a locking tooth as the leg slides between the channel openings and the base. An O-ring in an end groove on the leg prevents the leg from falling through the adjuster. Radial teeth in the base mate with radial depressions in the cap as the cap is rotated relative to the base. The invention thus affords fast, convenient, stepwise ("click-stop") adjustment of the longitudinal and angular position of the legs.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 1:
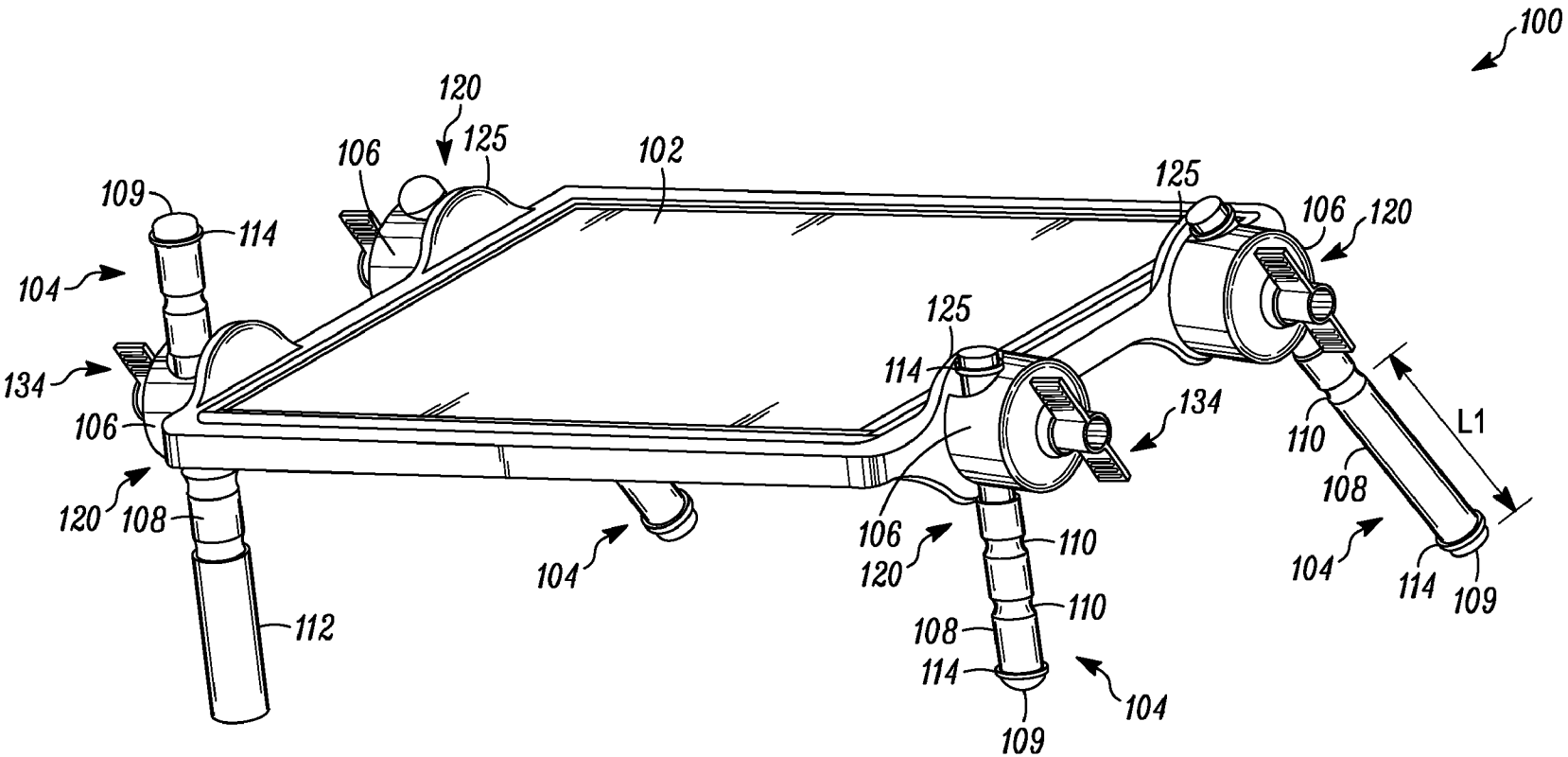
Figure 2:
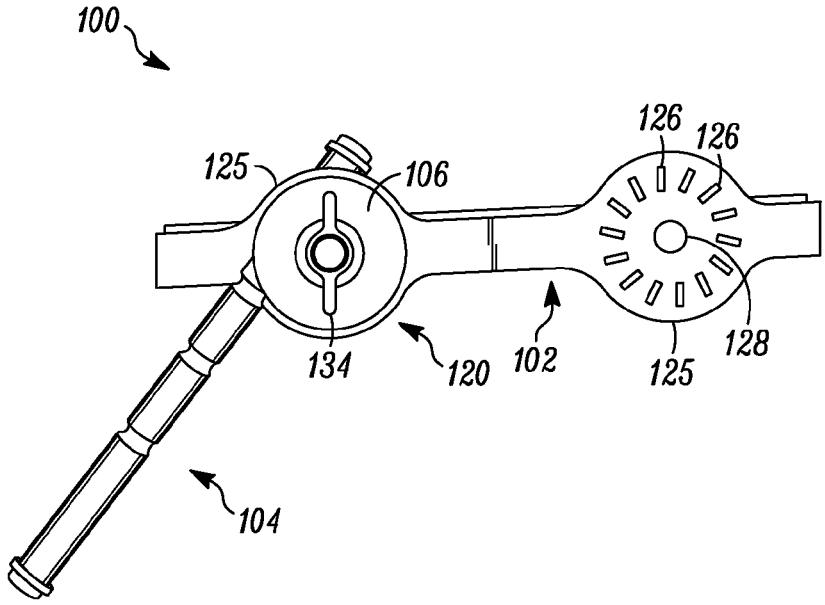
Figure 3:
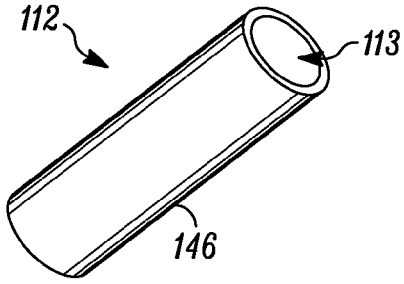
Figure 4:
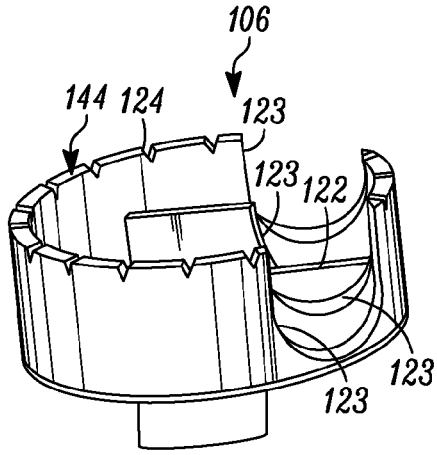
Figure 5:
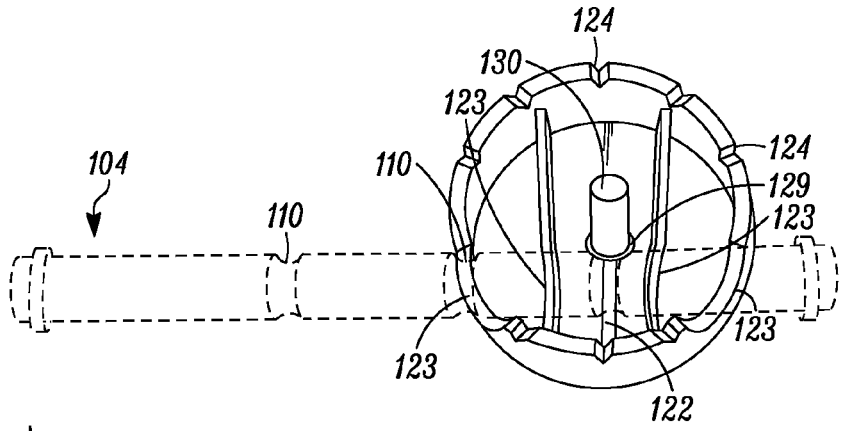
Figure 6:
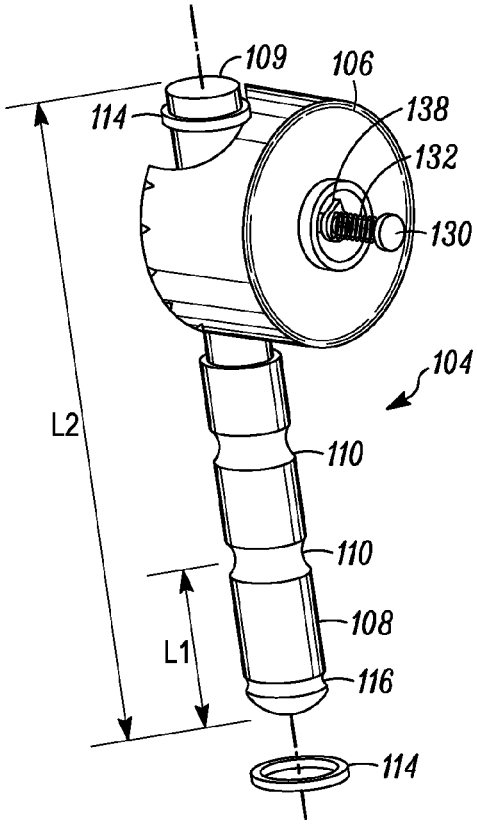
Figure 7:
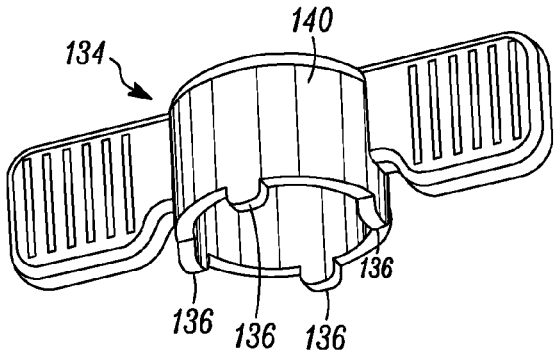

The structure, operation, and advantages of the present preferred embodiment of the invention will become further apparent upon consideration of the following description taken in conjunction with the accompanying drawings, wherein:

FIG. 1 is a perspective view of a work support with four leg adjusters, according to the invention;

FIG. 2 is a side view of the work support showing details of an adjuster base, according to the invention;

FIG. 3 is a perspective view of a leg extension that can be mated with a work support leg, according to the invention;

FIG. 4 is a perspective side view of a cap portion of the leg adjuster, according to the invention;

FIG. 5 is a perspective bottom view of the cap holding the work support leg (ghosted), according to the invention;

FIG. 6 is a perspective top view of the cap holding the work support leg, according to the invention;

FIG. 7 is a perspective side view of a knob for use in locking the leg adjuster, according to the invention;

FIG. 8 is a side view of the knob, cap, and base held together by a pin, an obstructing shoulder portion of the cap having been cut away, according to the invention;

FIG. 8A is a magnified view of a cam portion of the adjuster as indicated by the circular outline in FIG. 8; and FIG. 9 is a cross-sectional side view of the adjuster, the view taken as indicated by the line 9 in FIG. 8, according to the invention.

DETAILED DESCRIPTION OF THE INVENTION

FIG. 1 shows an overall perspective view of an inventive work support 100 illustrating several inventive forms of adjustable legs 104, not all of which would be used combined as shown. The work support 100 includes a platform 102 with leg adjusters 120, typically four as illustrated by the embodiment of FIG. 1. Each leg adjuster 120 comprises a base 125 that is molded as part of, or attached through some other means to, the side of the platform 102, a rotating cap 106, a manual locking knob 134 (preferably wing shaped), and an adjustable leg 104. Each leg 104 comprises a series of longitudinally spaced notches 110 (e.g., a circumferential groove on a cylindrical leg post), a protrusion 114 (e.g., O-ring) at each leg end 109, and a leg shank 108 of length L1 onto which a leg extension 112 may be attached to increase the effective length of the leg 104.

FIG. 2 shows a side view of the work support 100 with the platform 102, leg adjuster 120, and an adjuster base 125 onto which the cap 106 can be movably attached. The base 125 has at least one, and preferably an arcuate series of, teeth 126 (e.g., radial ridges) spaced around an arc having a radius of curvature, and a central hole 128 at the axis of the radius of curvature. The purposes of the teeth 126 and the hole 128 will be elucidated later in this description.

FIG. 3 shows further detail of the leg extension 112. A short cavity 113 is dimensioned to accept the leg shank 108 such that friction from the O-ring 114 holds the leg extension 112 in place. The leg extension 112 thus allows customizability in the length of the leg 104 and is optionally covered at least at the bottom end with a cushioning and/or non-slip material 146 (e.g., resilient foam).

FIGS. 4 and 5 show detailed perspective views of the cap 106. The cap 106 is arranged around a rotational axis defined by an axle pin 130 passing through a center hole 128, and has a planar first axial side 144, the plane being normal to the axle pin 130. A channel 123 crosses the cap 106 parallel to the first axial side 144 of the cap 106, is open on the first axial side 144, and is dimensioned to hold the leg 104 between the channel 123 and the plane defined by the first axial side 144. Protruding into the channel 123 is a locking tooth 122 (e.g., a ridge) that is dimensioned to mate with the notches 110 in the leg 104 when it is in the channel 123. A bottom view of the cap 106 with a mated leg 104 (a portion thereof being shown in ghosted outline) is illustrated in FIG. 5. Thus, a leg 104 properly placed in the channel 123 is held against longitudinal leg movement by the locking tooth 122, especially when the leg 104 is pressured along a side of it opposite the locking tooth 122. The illustrated embodiment of the cap 106 is made of molded plastic, so it is hollow to minimize plastic use. Therefore the channel 123 is implemented as a series of four plastic ridges, each one of which forms a short portion of the channel 123 across its width, as shown. Likewise, the tooth 122 is another ridge with a top edge that protrudes into the path of the channel 123.

The cap 106 has an arcuate series of spaced-apart depressions 124 which are dimensioned to mate with the one or more teeth 126 of the base 125. The teeth 126 are also shaped such that when the teeth 126 are mated with the depressions 124, the cap 106 can be rotated about the base hole 128 such that the teeth 126 move out of the depressions 124 to which they are mated and into adjacent depressions 124. Thus the cap 106, when rotated, will change the angular position of the leg 104 when it is in the channel 123. Although the drawings discussed herein show depressions 124 on the cap 106 and the teeth 126 on the base 125, the depressions 124 and the tooth/teeth can of course be on either the cap 106 or the base 125.

FIG. 6 shows a top view of the cap with a mated leg 104. An axle pin 130 passes through a spring 132, preferably a compression spring, and a central cap hole 129, which is rimmed by a rotary cam 138 comprising at least one, but preferably four, two-step 137 cam sets. Although the embodiment disclosed herein shows a coiled spring 132, the invention can accommodate other types of springs 132 (e.g. a beveled spring washer). The spring 132 biases the cap 106 against the leg 104. At each end of the leg 104 the O-ring 114 is stretch-fitted into an end groove 116. In addition to providing friction to hold the leg extension 112, the O-ring 114 also serves as a laterally protruding end stop to prevent the leg 104 from slipping through and out of the channel 123. The leg 104 also has an overall leg length L2 that can be varied by providing different lengths L1 for the shank 108. Two shank lengths L1 are shown (compare FIGS. 1 and 6), though an array of lengths can be accommodated, e.g., 6", 9", 12". For example, the leg 104 in FIG. 6 is 6" (six inches) long (L2), comprising a shank length L1 of 1.5", a 3" notched portion divided into 1" increments by the notches 110, and a top end 109 also being 1.5 inches long. For a 9" version, the length L1 of the shank 108 is increased to 4.5" and everything else stays the same.

FIG. 8 shows a side view, while FIG. 9 shows the same view in cross-section, of the knob 134, the cap 106, and the base 125, through all of which passes the axle pin 130. A head or clip ring 142 in a groove on one end of the axle pin 130 and a clip ring 142 in a groove on the other end hold everything together with pressure from the spring 132 biasing the cap 106 against the base 125. The knob shank 140 is hollow to contain the pin 130 while a number of cam riders 136 equal to the number of cam sets in the rotary cam 138 rim one end of the knob shank 140. This is shown in further detail in FIG. 7. Although only one cam set 138 and one cam rider 136 are needed, four are shown as preferred in order to prevent wobbling of the knob 134. Thus, the cam rider(s) 136 of the knob 134 can be mated with the cam (sets) 138 of the cap 106, as shown in the close-up view of FIG. 8A. For a given cam set 138, when the knob 134 is in the "LOCK" position, the cam rider 136 rests on a middle step 137*b* of the cam 138. A top step 137*c* is a stop that prevents any further rotation of the knob 134 in the "LOCK" direction, providing a discrete stopping point for the cam rider 136. When the knob 134 is turned in the "UNLOCK" direction, the cam rider 136 moves to the bottom step 137*a*, while another top step 137*c* once again stops any further rotation. The extra space afforded by the bottom step 137*c* allows the cap 106 to be moved out against the spring bias such that the teeth 126 are no longer mated with the depressions 124. This allows the angular position of an object placed in the channel 123 (e.g. a leg) to be adjusted by applying torque to the cap 106.

The unique locking and unlocking ability afforded by the knob 134 and cam 138, combined with a click-stop system, allows simultaneous, one-handed adjustment of the angular and longitudinal position of the leg 104. When one wants to make leg 104 adjustments, one merely needs to turn the knob 134 in a discrete turn to the "UNLOCK" position, which enables adjustment of the leg 104 in discrete units of adjustment. Moreover, even while unlocked, the adjuster 120 will hold any given leg 104 position setting by spring bias 132 until light force is exerted to either turn the cap 106 or longitudinally push/pull the leg 104 from one "click-stop" setting to the next, either angularly or longitudinally, individually or simultaneously. The spring 132 causes the movements to "click" and stop when the leg 104 or cap 106 moves to a new mating engagement of tooth/depression (122/110 or 126/124, respectively). Because the click stop positions are spaced apart in relatively large increments (e.g., one inch spacing between leg grooves 110, e.g., fifteen degree angular increments between cap/base depressions 124) a leg position setting made and locked in on a first leg 104 is easily recognized for duplicating on a second leg 104 of the work support 100. Again one-handed adjustment is enabled since a plurality of legs 104 can be adjusted one at a time.

Thus, longitudinal and angular adjustment of the leg 104 is controlled by a single knob 134, allowing simple and quick click-stop style adjustment. This is especially important for people with physical handicaps including, for example, limited arm/hand dexterity, strength, and/or mobility, for whom extra convenience can mean the difference between the ability and inability to adjust a work support by themselves. This also allows the inventive work support 100 to be used in a variety of situations and for a variety of purposes (e.g. in bed for reading a book, in a chair or wheelchair for holding a laptop or keyboard, etc.). Thus, the easily adjustable inventive work support 100 offers superior convenience for both handicapped and able-bodied people.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. Apparatus for adjusting the longitudinal and angular leg position for a work support comprising a platform supported by one or more legs, the apparatus comprising:

a base attached to the platform, a rotating cap, an elongated leg, a spring biasing the cap against the base, and an axle pin rotatably extending through the base and cap wherein:

the cap and base meet at a substantially planar base interface having an arcuate series of depressions on one of the cap and base, and at least one mating tooth on the other one of the cap and base, the arc being concentric with an axis of rotation defined by the axle pin;

the leg passes through a channel in the cap, the channel being open to the base interface and having a locking tooth therein that mates with any one of a series of longitudinally spaced apart notches in the leg when the base interface is mated tooth-in-depression;

a manual locking knob is rotatably mounted on the axle pin, meeting the cap at a cam interface axially opposite the cap's base interface, with the knob being spring biased away from the cap and against a head end of the axle pin;

the cam interface comprises high and low cam steps on one of the knob and the cap, and a cam rider on the other one of the knob and the cap; and when manually rotated, the knob is restricted to moving the cam rider between the high and low cam steps, the low step allowing separation between the cap and the base for adjustment of the leg position; and the high step locking the cap against the base such that the base interface is mated tooth-in-depression, thereby locking the leg in position after adjustment.

2. The apparatus of claim 1, further comprising:

an end stop protruding laterally from an end of the leg, dimensioned and positioned to stop the leg end from passing through the channel.

* * * * *